United States Patent [19]

Grindstaff et al.

[11] Patent Number: 5,069,844

[45] **Date of Patent: * Dec. 3, 1991**

[54] IMPROVEMENTS IN PROCESS FOR PREPARING CRYSTALLINE SPIN-ORIENTED FILAMENTS

[75] Inventors: Teddy H. Grindstaff; Cecil E. Reese, both of Kinston, N.C.

[73] Assignee: E. I. Du Pont de Nemours and Company, Wilmington, Del.

[ * ] Notice: The portion of the term of this patent subsequent to Dec. 3, 2008 has been disclaimed.

[21] Appl. No.: 420,459

[22] Filed: Oct. 12, 1989

Related U.S. Application Data

[63] Continuation-in-part of Ser. No. 228,802, Jul. 28, 1988, abandoned, which is a continuation of Ser. No. 934,215, Nov. 21, 1986, abandoned.

[51] Int. Cl.[5] ..... D01F 6/62; D01F 11/04

[52] U.S. Cl. ..... 264/103; 264/129; 264/130; 264/211.14; 264/211.15; 264/233

[58] Field of Search ..... 264/211.14, 129, 130, 264/103, 211.15, 233

[56] References Cited

U.S. PATENT DOCUMENTS

| | | | |
|---|---|---|---|
| 3,110,617 | 11/1963 | Scott | 427/175 |
| 4,316,924 | 2/1982 | Minemura et al. | 428/89 |
| 4,396,389 | 8/1983 | Löffren | 8/115.5 |

FOREIGN PATENT DOCUMENTS

| | | |
|---|---|---|
| 3324662 | 7/1982 | Fed. Rep. of Germany . |
| 1189299 | 10/1959 | France . |
| 47-35608 | 9/1972 | Japan . |
| 49-1257 | 1/1974 | Japan . |
| 55-4845 | 2/1980 | Japan . |
| 56-31073 | 3/1981 | Japan . |
| 56-140167 | 11/1981 | Japan . |
| 58-169512 | 12/1983 | Japan . |
| 58-180672 | 1/1984 | Japan . |
| 61-231218 | 3/1987 | Japan . |
| 839456 | 6/1960 | United Kingdom . |
| 850169 | 9/1960 | United Kingdom . |
| 1093628 | 12/1967 | United Kingdom . |
| 1276329 | 6/1972 | United Kingdom . |

*Primary Examiner*—Hubert C. Lorin

[57] ABSTRACT

Polyester crystalline filaments that have been prepared by spin-orientation, and filaments prepared by drawing such filaments without texturing, in yarns thereof, and in fabrics and garments thereof, are prepared by an improved process involving treatment of freshly-extruded polyester filaments with caustic in the spin-finish, so as to improve moisture-wicking properties.

4 Claims, No Drawings

IMPROVEMENTS IN PROCESS FOR PREPARING CRYSTALLINE SPIN-ORIENTED FILAMENTS

CROSS-REFERENCE TO RELATED APPLICATIONS

This application is a continuation-in-part of copending application Ser. No. 07/228,802 now abandoned, filed July 28, 1988, which itself is a continuation of application Ser. No. 06/934,215, filed Nov. 21, 1986, now abandoned.

TECHNICAL FIELD

This invention concerns improvements in and relating to crystalline spin-oriented filaments and yarns of the polyester type, and more particularly to such whose filamentary materials are modified to provide entirely new properties, and including textile articles such as fabrics and garments containing such filamentary materials and yarns.

BACKGROUND OF THE INVENTION

Synthetic polyester yarns have been known and used commercially for several decades, having been first suggested by W. H. Carothers, U.S. Pat. No. 2,071,251, and then by Whinfield and Dickson, U.S. Pat. No. 2,465,319. In order to obtain polyester filamentary materials that have properties that enable them to be used in fabric construction, e.g. by knitting or weaving, it was originally thought necessary to subject the melt-spun (extruded) solid filaments to a drawing operation to increase their orientation and crystallinity. Although, in the 1950's, Hebeler, U.S. Pat. No. 2,604,667, suggested that it was possible to eliminate the drawing stage by winding up undrawn filaments at a high withdrawal speed (at least 5,200 ypm), decades passed before significant further progress was achieved towards commercial adoption of high speed spinning without requiring drawing. Essentially two techniques are now available. Knox, U.S. Pat. No. 4,156,071, discloses filamentary materials that are both crystalline and highly oriented, as defined therein, and such filaments have been prepared by spinning at withdrawal speeds of the order of 4 km/min (about 3.4 to 4.6 km/min). Frankfort and Knox, U.S. Pat. Nos. 4,134,882 and 4,195,051, disclose how to overcome difficulties in preparing filaments at the higher withdrawal speeds earlier suggested by Hebeler and the properties of the resulting new filaments. The present invention concerns the improvement of both these types of crystalline spin-oriented filamentary materials, it being understood that the present invention is not limited to operation only in the precise circumstances disclosed by the above patentees, and that there have been several disclosures of spinning crystalline spin-oriented filaments at such and higher withdrawal speeds. Although it is possible to use most such crystalline spin-oriented filaments directly in fabric construction without further drawing, it may prove advantageous to draw such filaments for certain purposes, as disclosed for example in copending application Ser. No. 07/338,251, filed Apr. 14, 1989, by Knox and Noe, and this will change the properties of the materials in certain respects that may be advantageous.

Polyester multi-filament yarn has been recognized as having significant advantages over cotton yarns in some respects, for instance its thermoplastic characteristics that enable polyester-containing fabrics to hold their shape, for instance a crease, and to have wash-wear characteristics, its low cost of manufacture, its uniformity, its superior strength, and its resistance to degradation. However, hitherto, some people have expressed a preference for wearing garments from cotton fibers because of attributes that can be summarized as "comfort", to the extent that there has been a trend recently towards using more 100% cotton fabrics, despite the practical advantages of wash-wear 100% polyester fabrics. Because of the sophistication of the textile industry, both of the polyester fiber manufacturing industry and of downstream consumers of textiles, and because of the commercial interest in providing apparel and fabrics that will perform well during actual use by the ultimate consumer (wearer), much attention has been devoted to analyzing appropriate requirements. Many technical papers, for example, have been published on various aspects, and patents have been issued with the objective of improving the "comfort" that can be obtained from textile articles, and their constituents, and the literature has been replete with these suggestions for several years. So it has long been considered desirable to improve various properties of textiles prepared from polyester yarns, and much effort has been devoted in the textile industry towards this objective.

An important objective of our invention is to provide crystalline polyester spin-oriented filaments and yarns, as mentioned above, in a new form, which can be formed into fabrics and garments that can show improved moisture-wicking properties, as discussed herein.

Polyester filaments are characterized by their extreme hydrophobic character, as mentioned in "Polyester Fibres—Chemistry and Technology", by H. Ludewig—English translation 1971—John Wiley and Sons, Ltd., in Section 11.1.5 on pages 377–378, and also in Section 11.4 on dyeing properties, starting on page 398. Indeed, the difficulty of dyeing polyester yarns and fabrics is notorious. Ludewig's book mentions many aspects of polyester fibers and their preparation and properties.

Polyester filaments are always manufactured by melt-spinning (i.e. extruding molten polyester polymer). Crystalline spin-oriented filaments are withdrawn at high speeds, as mentioned above, and are stable to storage and heat (like drawn polyester yarns), so that they can be processed without difficulty, even at elevated temperatures, e.g. of the order of 200° C., if desired. In this respect, crystalline yarns are entirely different from amorphous yarns that used to be prepared at lower speeds (such as 1 km/min.) which often stick to heaters, and lose strength and break.

It is conventional to coat all freshly-extruded filaments with a "finish", which is generally an aqueous emulsion comprising a lubricant and an antistat. Finishes are discussed briefly in Section 5.5, starting on page 193, of Ludewig, referred to above. As mentioned on page 195, the literature reveals relatively little about the compositions of the spin-finishes that are actually used. Although there is now considerable patent and other literature, the precise finish formulations are generally closely-guarded secrets by the yarn manufacturers, and different compositions are formulated for different purposes, depending on the particular intended processing and possible specific requests by individual customers, and these formulations change, sometimes quite frequently. As will be related hereinafter, a dramatic change in the surface properties of the filaments, and of articles containing them, such as fabrics and garments, may be obtained by a relatively simple modification to the spin-finish that is applied to the freshly-extruded polyester crystalline spin-oriented filaments. Conventionally, the spin-finish is the first contact that a freshly-extruded filament encounters after solidification. The finish was generally applied by a finish roll, rotating in a bath of the finish, so that the filaments pass through the finish emulsion as they brush past the finish roll on their way from the solidification zone to the feed roll that determines the withdrawal speed from the spinneret. Before the finish roll, it is generally desirable to avoid or minimize contact between the filaments and solid objects, and so the only other closely-adjoining solid objects are generally guides that are intended to confine the filaments before contacting the finish roll. A finish roll is not the only method of applying finish, and other methods have been used and suggested, including spraying or metering the finish onto the filaments.

SUMMARY OF THE INVENTION

According to the present invention, the moisture-wicking properties of crystalline spin-oriented polyester filaments and yarns in textile fabrics and garments can be significantly changed by adding a small amount of caustic to the spin-finish, so that the caustic can modify the surface of the filaments as they are freshly extruded. This change has caused the polyester surface to be modified and have improved moisture-wicking properties, after washing. It is surprising that this long-desired improvement can be achieved by such a small change in the conventional process, and that this has not been reported hitherto, so far as I know, despite the many references in the literature to treatments, especially of fabric, with caustic soda among other materials.

Accordingly, there is provided an improvement in a process for preparing textile yarn consisting essentially of crystalline filaments that are spin-oriented, comprising the steps of melt-spinning polyester at high withdrawal speed into filaments, treating the freshly-extruded filaments with a finish, and collecting them in the form of a bundle, and processing them into a yarn, the improvement characterized by treating the freshly-extruded filaments so as to pick up a small amount of caustic, in sufficient amount and sufficiently rapidly so as to modify the surface of the polyester, so as to improve their moisture-wicking properties, after washing, and the resulting filamentary materials and yarns that are new and improved in that the polyester has such a modified surface that provides improved comfort to the new downstream articles, such as fabrics and garments that incorporate such yarns and/or materials.

DETAILED DESCRIPTION OF THE INVENTION

For convenience, despite the fact that the surface has been changed, so that the moisture-wicking characteristics are not what has hitherto been associated with "polyester" filaments and yarns, we shall refer to both treated and untreated materials by the term "polyester", for reasons which will be apparent.

At this point, we refer to copending applications Ser. No. 420,457 and Ser. No. 420,458 filed simultaneously herewith, because they describe corresponding surface-modification of polyester filaments during the preparation, respectively, of filamentary tows, staple fiber and spun yarn therefrom, and DTFY and textured yarns therefrom, and because development of some of those technologies has proceeded further, and so the disclosures therein are incorporated by reference, because it is believed that essentially similar technical findings will apply to the present invention and textile materials herein, and because several comments and in particular tests and comparisons, and some aspects of thresholds and amounts, related therein, could apply to the polyester filaments treated according to the present invention, with, however, also a caution that, since an essential element of the invention concerns working with freshly-extruded filaments and a rate phenomenon, as disclosed therein, in other words since this is a frehly-exposed surface phenomenon, if the dimensions and quantities of the treated filaments are changed significantly, adjustments have had to be made to the quantities of caustic to achieve the same desired effect, as can be seen by a comparison of the working Examples in the various cases.

The preparation of polyester filaments and yarns may be carried out conventionally, as described in the prior art, except for the application of caustic to the freshly-extruded filaments, and then the treated filaments may be processed conventionally, including further processing to form yarns, and eventually making fabrics, e.g. by knitting or weaving, and garments by conventional techniques. Generally, hitherto, spin-oriented polyester filaments have been prepared by melt-spinning, and the undrawn filaments have been treated with a spin-finish, collected into a bundle, interlaced, and wound up or further processed at high speeds, as indicated. According to the invention, this conventional process is modified by treating the freshly-extruded filaments with caustic, such as caustic soda or caustic potash. As indicated, this may most conveniently be effected by adding an appropriate amount of caustic to the finish that is applied to the freshly-extruded filaments, since the application of finish is essentially the first treatment or contact that the freshly-extruded filaments encounter after solidification. It is important, according to the invention, that this treatment with caustic be effected on these freshly-extruded filaments, which are often referred to as "live" filaments, since the effect appears to be different from that obtained if caustic soda is applied at a later stage to fabrics, according to prior art teaching. If the application of a small amount of caustic is not sufficiently prompt, the caustic will not improve the moisture-wicking properties significantly, as discussed in the copending application referred to.

We believe that there has been a chemical change to the surface of the filament, from its regular hydrophobic nature, that has been a characteristic of polyester as reported, e.g. by Ludewig. The core appears to be relatively unchanged from regular polyester polymer, whereas the surface has been significantly changed so that the yarn, fabric and garments show improved moisture-wicking properties, after washing. In order to obtain the improved properties, the filament surfaces must be washed, as described in copending application Ser. No. 420,457. This usually occurs during normal processing, e.g. of the fabrics, but may apply at any stage of processing of the filaments or yarns.

Precautions need to be taken and modifications must probably be made to avoid or minimize corrosion or other contamination and other disadvantages that may result because of the use of caustic according to the invention. For such reasons, hitherto, it has been considered highly undesirable to include any dangerous or corrosive material, such as caustic, even in the small amounts indicated, at this stage of the process. This is at least one reason why, so far as we know, hitherto, there has previously been a prejudice against the use of a material such as caustic at this stage of a process for preparing polyester filaments. In this regard, it should be recognized that the filaments travel at such high speeds that it is difficult to avoid 'slinging', i.e., release of droplets of finish from these high speed filaments after application of the finish.

The invention is further illustrated in the following Example, which compares the moisture-wicking properties of knitted fabrics from two multi-filament yarns made under essentially similar conditions (but with and without caustic in the spin-finish), following the procedure set out in U.S. Pat. No. 4,156,071.

EXAMPLE

The new yarn (A) of this invention is prepared with the same finish as is used commercially, except that sufficient KOH is added to raise the pH to about 12. The control yarn (C) is made under exactly the same conditions, except that the commercial finish is used without addition of KOH. The other conditions are essentially similar. Standard poly(ethylene terephthalate) of LRV about 21, containing 0.3% $TiO_2$ is spun through a spinneret containing 34 capillaries, each 15×60 mils (diameter and length) and with a round cross section. The spinning temperature is about 288° C. and was adjusted to give the best spinning. The extruded filaments are quenched with a crossflow of room temperature air. The finish is applied to the quenched filaments as they pass from the spinneret to the feed godet, using standard application hardware and technology. The filaments are wound up using a 3 godet system, and interlacing, with a spinning speed set at 4,500 ypm (4,115 mpm). Conditions for best spinning are found to be identical for both yarns. The properties are summarized in the Table, and show that spun yarn tensile and shrinkage properties are found to be equivalent.

The yarns are knit directly from the wound up package into tubing using a Lawson-Hemphill FAK circular knitter. The tubing is scoured to remove finish applied in spinning and all other extraneous oils and dirt. Part of the fabric is dyed using procedures accepted in the trade. Scoured fabric, either undyed or dyed, is carefully rinsed with water to insure that all scouring chemicals are removed. This is readily accomplished by putting the fabric in a Home Model Washing machine and running through a full wash cycle using the high temperature settings. The fabric is then allowed to dry thoroughly either in a home model dryer or in air.

When a drop of water is applied to control fabric C (of conventional polyester) it spreads very slowly, if at all. Even after several minutes, nearly all the water remains and can be removed with an eye dropper.

When a drop of water is applied to new fabric A it spreads very rapidly, within about a second, over a wide section of the fabric surface. Thus fabric A has excellent wickability.

TABLE

| | A | C |
|---|---|---|
| DENIER | 100 | 100 |
| MODULUS | 41 | 41 |
| TENACITY | 3.31 | 3.24 |
| ELONGATION | 87 | 87 |
| BOS (%) | 5.9 | 5.3 |

In copending application Ser. No. 420,457 caustic soda (NaOH) has been used, and in copending application Ser. No. 420,458 caustic potash also has been used to improve the moisture-wicking performance of polyester yarns, and fabrics thereof, so it is to be expected that other alkali metal hydroxides, alkaline earth metal hydroxides or equivalent basic materials may give an essentially equivalent effect.

As mentioned in copending application Ser. No. 420,457, fabrics and garments from the spun yarns in the Example therein are expected to provide soft, dry, cool and airy aesthetics, and more breathability, and that the hydrophilic surface-modified polyester is expected to give even more of the advantages where improved moisture-wicking is important, such as coolness and dryness, (as compared with prior art polyester that has not been surface-modified). Similarly, fabrics and garments from yarns or fiber according to the present invention are expected to show advantages where moisture-wicking is important.

The filaments may be of conventional deniers and other characteristics for making yarns and fabrics and garments therefrom, using conventional techniques. The filaments may be round or of any other cross-sections, such as scalloped-oval, or trilobal, if desired.

In addition to conventional polyester, i.e. poly(ethylene terephthalate) such as is used in the Examples of this and of the copending applications mentioned above, other polyesters, such as copolymers, e.g. with cationic or other dye-modifiers, may be used, and changes may be made accordingly to correspond with such changes to the polymer, e.g. in the methods of preparation and testing. The advantage of the invention is that the normal hydrophobic surface is significantly changed by the simple treatment of freshly-extruded filaments with caustic according to the invention, and the invention is not considered restricted by the nature of the polyester polymer, nor by the cross-section or configuration of the filaments. Indeed, we believe that certain copolymers and special configurations may respond somewhat more easily to surface-modification.

We claim:

1. An improvement in a process for preparing a textile yarn consisting essentially of crystalline filaments that are spin-oriented, comprising the steps of melt-spinning and quenching polyester at high withdrawal speed into filaments, treating the freshly-extruded filaments with a spin-finish and collecting them in the form of a bundle, and processing them into a yarn, wherein the improvement consists in treating the freshly-extruded filaments with a spin-finish containing an amount of caustic selected and at a location selected such that, in combination with the withdrawal speed and quenching conditions, the caustic treatment is sufficiently soon so as to modify the surface of the polyester, so as to improve the moisture-wicking properties, after washing, as indicated by the polyester having at least 0.2 surface carboxyl equivalents per million grams of fiber in the textile yarn.

2. A process according to claim 1, wherein the freshly-extruded polyester filaments are treated so that the polyester has at least 0.3 surface carboxyl equivalents per million grams of drawn fiber.

3. A process as claimed in claim 1 or 2, wherein the filaments are spun at a withdrawal speed of about 3.4 to about 4.6 km/min to provide filaments having a boil-off shrinkage of about 6% or less and a thermal stability as shown by an $S_2$ value of 2% or less.

4. A process as claimed in claim 1 or 2, wherein the filaments are spun at a withdrawal speed of at least about 5 km/min.

* * * * *